US009752539B2

(12) United States Patent
Burleigh et al.

(10) Patent No.: US 9,752,539 B2
(45) Date of Patent: Sep. 5, 2017

(54) METHOD FOR DIAGNOSING LEAKS DOWNSTREAM OF THE PURGE FLOW CONTROL ORIFICE

(71) Applicant: GM Global Technology Operations LLC, Detroit, MI (US)

(72) Inventors: Darrell W. Burleigh, Fenton, MI (US); Sergio Quelhas, Ann Arbor, MI (US); Lawrence A. Staat, Sterling Heights, MI (US); Kenneth C. Swartz, Commerce Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/140,439

(22) Filed: Apr. 27, 2016

(65) Prior Publication Data

US 2016/0369714 A1 Dec. 22, 2016

Related U.S. Application Data

(60) Provisional application No. 62/181,462, filed on Jun. 18, 2015.

(51) Int. Cl.
*F02M 33/04* (2006.01)
*F02M 25/08* (2006.01)

(52) U.S. Cl.
CPC .... *F02M 25/0854* (2013.01); *F02M 25/0836* (2013.01); *F02M 25/0818* (2013.01); *F02M 2025/0845* (2013.01)

(58) Field of Classification Search
CPC ..... F02M 25/0854; F02M 25/0836; F02M 25/0845; F02M 25/0818
USPC ..... 123/520; 701/107; 73/114.39
See application file for complete search history.

(56) References Cited

U.S. PATENT DOCUMENTS 6,152,115 A * 11/2000 Busato ..... F02M 25/0836 123/520
6,330,878 B1 * 12/2001 Perry ..... F02M 25/0836 123/519
6,668,807 B2 * 12/2003 Weldon ..... F02M 25/0836 123/516
6,739,573 B1 * 5/2004 Balsdon ..... F16K 31/0696 251/129.05
7,661,654 B2 * 2/2010 Okuda ..... F02M 25/0836 251/366

(Continued)

*Primary Examiner* — Hai Huynh
(74) *Attorney, Agent, or Firm* — Harness, Dickey & Pierce, P.L.C.

(57) ABSTRACT

A vapor purge system for an engine, includes a purge valve having a housing including an input port in communication with a purge canister and including an output port in communication with an intake system component defining a first bore portion receiving the output port with a first seal member disposed therebetween. The intake system component includes a second bore portion receiving a housing portion of the purge valve with a second seal member disposed therebetween. The first and second seal members are spaced such that when the housing is pulled away from the intake system component and the first seal member is out of engagement between the first bore and the output port, the second seal member can remain in engagement so that a diagnostic module can diagnose detachment of the purge valve from the intake system before any hydrocarbon vapor can be released into the atmosphere.

4 Claims, 4 Drawing Sheets

(56) References Cited

U.S. PATENT DOCUMENTS

| | | | | |
|---|---|---|---|---|
| 9,097,216 | B2 * | 8/2015 | Itoh | F02M 25/0854 |
| 9,127,605 | B2 * | 9/2015 | Plymale | F02D 41/004 |
| 9,562,499 | B2 * | 2/2017 | Swartz | F02M 25/0818 |
| 2016/0061154 | A1 | 3/2016 | Swartz et al. | |

* cited by examiner

METHOD FOR DIAGNOSING LEAKS DOWNSTREAM OF THE PURGE FLOW CONTROL ORIFICE

CROSS-REFERENCE TO RELATED APPLICATIONS

This application claims the benefit of U.S. Provisional Application No. 62/181,462, filed Jun. 18, 2015. The entire disclosure of the above application is incorporated herein by reference.

FIELD

The present disclosure relates to internal combustion engines and more particularly to systems and methods for diagnosing leaks downstream of the purge flow control orifice.

BACKGROUND

This section provides background information related to the present disclosure which is not necessarily prior art.

Internal combustion engines combust a mixture of air and fuel to generate torque. The fuel may be a combination of liquid fuel and vapor fuel. A fuel system supplies liquid fuel and vapor fuel to the engine. A fuel injector provides the engine with liquid fuel drawn from a fuel tank. A vapor purge system provides the engine with fuel vapor drawn from a vapor canister.

Liquid fuel is stored within the fuel tank. In some circumstances, the liquid fuel may vaporize and form fuel vapor. The vapor canister traps and stores the fuel vapor. The purge system includes a purge valve. Selective actuation of the purge valve allows the fuel vapor to be drawn into the intake manifold and purge the fuel vapor from the vapor canister.

SUMMARY

This section provides a general summary of the disclosure, and is not a comprehensive disclosure of its full scope or all of its features.

In a feature, a diagnostic system for a vehicle is disclosed. A purge valve control module closes a purge valve that regulates fuel vapor flow from a fuel vapor canister to an intake system of an engine. After the closing of the purge valve, a pump control module turns on a pump that pumps fuel vapor toward the purge valve. After the purge valve is closed, a pressure module determines a pressure measured using a pressure sensor located between the pump and the purge valve. A diagnostic module selectively diagnoses any leaks downstream of the purge flow control orifice based on the pressure.

In further features, the purge valve includes: a housing having an input port for receiving output from the pump; an output port for engaging an input port of a component of the intake system and a first seal that sealingly engages the purge valve output port to the input port of the intake system, and a second seal that sealingly engages the housing and a bore in the component.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
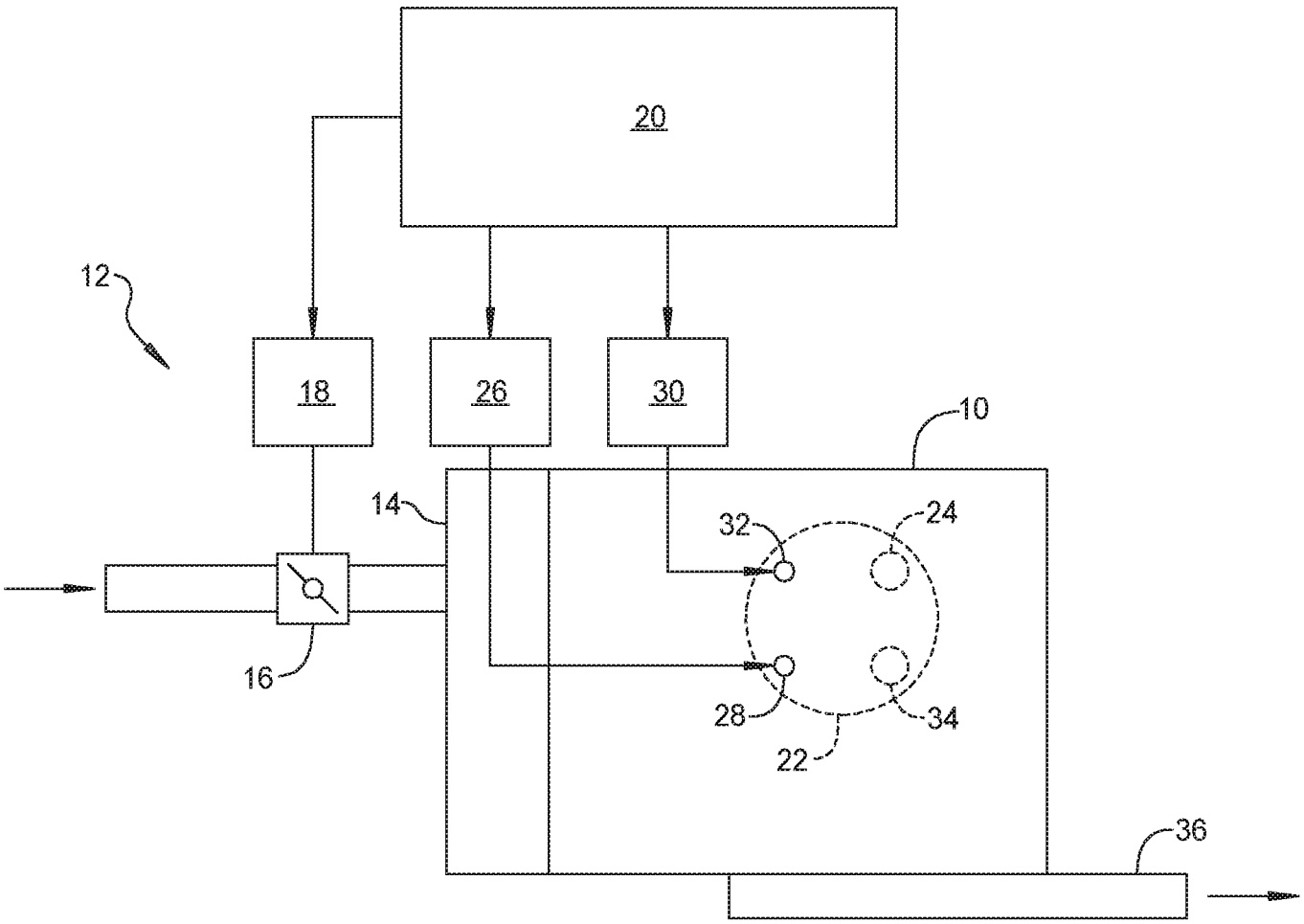
FIG. 1 is a functional block diagram of an example direct injection engine system.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

A fuel system includes a vapor canister that traps and stores fuel vapor. A purge valve is selectively opened to purge the fuel vapor from the vapor canister to an internal combustion engine. In some types of engines, such as naturally aspirated engines, vacuum within an intake manifold may be used to draw fuel vapor through the purge valve. Other types of engines, such as boosted engines, may have insufficient vacuum or boost to draw fuel vapor through the purge valve. A pump may be used to pump fuel vapor from the vapor canister to an intake system of engines having insufficient boost or vacuum. Some purge valves may be directly coupled to a component of an intake system of an engine.

A control module selectively closes a purge valve and activates a pump to determine whether the purge valve is detached from an intake system of an engine. Closing the purge valve prevents fuel vapor flow into the intake system. However, fuel vapor may exit the purge valve when the purge valve is detached from the intake system. The control module therefore determines whether the purge valve is detached based on whether a pressure measured at a location between the pump and the purge valve increases over time when the purge valve is closed and the pump is on.

Referring now to FIG. 1, a functional block diagram of an example engine system for a vehicle is presented. An engine 10 combusts an air/fuel mixture to produce drive torque for a vehicle. While the engine 10 will be discussed as a spark ignition direct injection (SIDI) engine, the engine 10 may include another type of engine. One or more electric motors and/or motor generator units (MGUs) may be provided with the engine 10.

Air flows into the engine 10 via an intake system 12. More specifically, air flows into an intake manifold 14 through a throttle valve 16. The throttle valve 16 may vary airflow into the intake manifold 14. For example only, the throttle valve 16 may include a butterfly valve having a rotatable blade. A throttle actuator module 18 (e.g., an electronic throttle controller or ETC) controls opening of the throttle valve 16 based on signals from an engine control module (ECM) 20. In various implementations, the intake system 12 includes one or more boost devices, such as one or more superchargers and/or one or more turbochargers, that increase airflow into the intake manifold 14 and, therefore, the engine 10.

Air from the intake manifold 14 is drawn into cylinders of the engine 10. While the engine 10 may include more than one cylinder, only a single representative cylinder 22 is shown. Air from the intake manifold 14 is drawn into the cylinder 22 through one or more intake valves of the cylinder 22, such as an intake valve 24. One or more intake valves 24 may be provided with each cylinder 22.

A fuel actuator module 26 controls fuel injectors of the engine 10, such as fuel injector 28, based on signals from the ECM 20. A fuel injector 28 may be provided for each cylinder. The fuel injectors 28 inject fuel, such as gasoline, for combustion within the cylinders. The ECM 20 may control fuel injection to achieve a target air/fuel ratio, such as a stoichiometric air/fuel ratio.

The injected fuel mixes with air and creates an air/fuel mixture in the cylinder 22. Based upon a signal from the ECM 20, a spark actuator module 30 may energize a spark plug 32 in the cylinder 22. A spark plug 32 may be provided for each cylinder. Some types of engines, such as diesel engines, do not include spark plugs. Spark generated by the spark plug 32 ignites the air/fuel mixture. Exhaust resulting from combustion is expelled from the cylinder 22 via one or more exhaust valves, such as exhaust valve 34, to an exhaust system 36. One or more exhaust valves may be provided for each cylinder.

Figure 2:
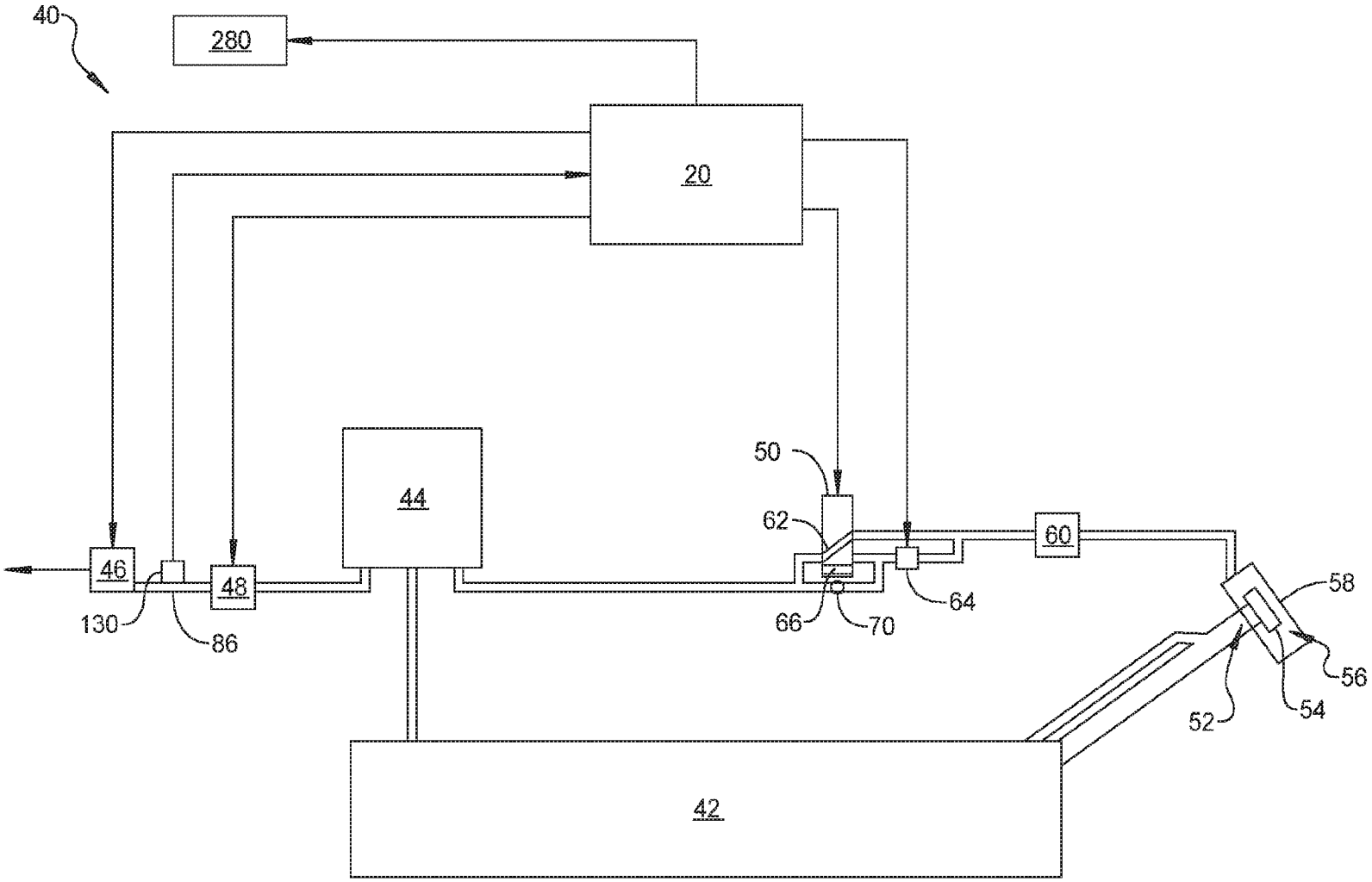
FIG. 2 illustrates an example fuel system and control system.

Referring now to FIG. 2, a functional block diagram of an example fuel system 40 is presented. The fuel system 40 supplies fuel to the engine 10. More specifically, the fuel system 40 supplies both liquid fuel and fuel vapor to the engine 10. The fuel system 40 includes a fuel tank 42 that contains liquid fuel. Liquid fuel is drawn from the fuel tank 42 and supplied to the fuel injectors of the engine 10 by one or more fuel pumps (not shown).

Some conditions, such as refueling, heat, vibration, and/or radiation, may cause liquid fuel within the fuel tank 42 to vaporize. A vapor canister 44 traps and stores vaporized fuel (fuel vapor). The vapor canister 44 may include one or more substances that trap and store fuel vapor, such as a charcoal.

A purge valve 46 includes a valve member that is selectively opened and closed to enable and disable, respectively, fuel vapor flow to the engine 10. An example illustration of the purge valve 46 is provided in FIGS. 3 and 4. Operation of the engine 10 may create a vacuum relative to ambient pressure within the intake manifold 14.

In some instances, such as when one or more boost devices are increasing airflow into the engine 10, pressure within the intake manifold 14 may be greater than or approximately equal to ambient pressure. A pump 48 may be implemented that pumps fuel vapor from the vapor canister 44 to the purge valve 46. When the purge valve 46 is open, the pump 48 also pumps fuel vapor from the vapor canister 44 toward the engine 10.

The ECM 20 controls the purge valve 46 and the pump 48 to control the flow of fuel vapor to the engine 10. The ECM 20 may also control a switching valve 50. When the switching valve 50 is in a vent position, the ECM 20 may selectively open the purge valve 46 and turn on the pump 48 to purge fuel vapor from the vapor canister 44 to the intake system 12.

The ECM 20 may control the rate at which fuel vapor is purged from the vapor canister 44 (a purge rate) by controlling opening and closing of the purge valve 46. For example only, the ECM 20 may control the purge rate, the purge valve 46 may include a solenoid valve, and the ECM 20 may control the purge rate by controlling duty cycle of a signal applied to the purge valve 46. Ambient air flows into the vapor canister 44 as fuel vapor flows from the vapor canister 44 toward the intake system 12.

A driver of the vehicle may add liquid fuel to the fuel tank 42 via a fuel inlet 52. A fuel cap 54 seals the fuel inlet 52. The fuel cap 54 and the fuel inlet 52 may be accessed via a fueling compartment 56. A fuel door 58 may be implemented to shield and close the fueling compartment 56.

The ambient air provided to the vapor canister 44 through the switching valve 50 may be drawn from the fueling compartment 56. A filter 60 receives the ambient air and filters various particulate from the ambient air.

The switching valve 50 may be actuated to the vent position or to a pump position. The switching valve 50 is shown as being in the vent position in the example of FIG. 2. When the switching valve 50 is in the vent position, air can flow from the filter 60 to the vapor canister 44 via a first path 62 through the switching valve 50. When the switching valve 50 is in the pump position, air can flow between a vacuum pump 64 and the vapor canister 44 via a second path 66 through the switching valve 50.

When the vacuum pump 64 is on while the switching valve 50 is in the pump position, the vacuum pump 64 may draw gasses (e.g., air) through the switching valve 50 and expel the gasses through the filter 60. The vacuum pump 64 may draw the gasses through the second path 66 and a reference orifice 70. A relief valve (not shown) may be implemented to selectively discharge pressure or vacuum within the fuel system 40. The vacuum pump 64 may be operated, for example, to determine whether one or more leaks are present in the fuel system.

The purge valve 46 is directly coupled to a component of the intake system 12, such as the intake manifold 14 or an intake pipe through which air flows into the intake manifold 14. In engines having a boost device, the purge valve 46 may be directly coupled to a component upstream of the boost device.

Figure 3:
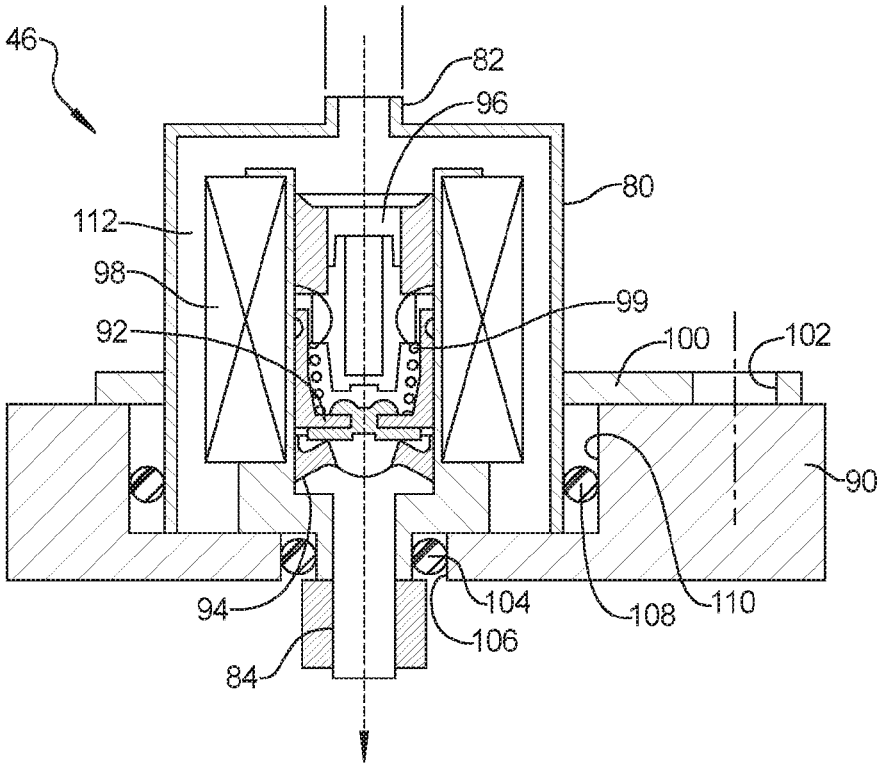
FIG. 3 is an example illustration of a purge valve that is attached to a component of an air intake system.

FIG. 3 includes an example illustration of the purge valve 46 including a housing 80 having an inlet port 82 and an outlet port 84. The inlet port 82 is connected to a passage 86 (FIG. 2) that is in communication with the pump 48. The outlet port 84 can be connected to a component 90 (FIGS. 3, 4) of the intake system 12.

The purge valve 46 includes a valve member 92 that engages a valve seat 94 that selectively opens and closes off a first passage 96 extending through the housing 80. The purge valve 46 includes a solenoid coil 98 that is provided with a control signal to actuate the valve to electro-magnetically move the valve member 92 to an open position against a biasing force of a spring 99.

The housing 80 can include a mounting flange 100 with an aperture 102 for receiving a threaded fastener for securing the housing 80 to the component 90 of the intake system. The outlet port 84 includes an O-ring seal 104 that sealingly engages an inner surface of a first bore portion 106 of the component 90. A second O-ring seal 108 is provided for sealingly engaging an outer surface of the housing 80 and an inner surface of a second bore portion 110 of the component 90. The housing 80 further defines a second passage 112 (see FIG. 4) in communication with the inlet opening 82 and a second end 114 of the housing 80.

In the normal assembled condition of the purge valve 46 (shown in FIG. 3), the first O-ring seal 104 is sealingly engaged between the outlet port 84 and the inner surface of the first bore portion 106. In addition, the second O-ring seal 108 is sealingly engaged between the outer surface of the housing 80 and the inner surface of the second bore portion 110. The second end 114 of the housing 80 also engages an end wall 116 of the second bore portion 110.

Figure 4:
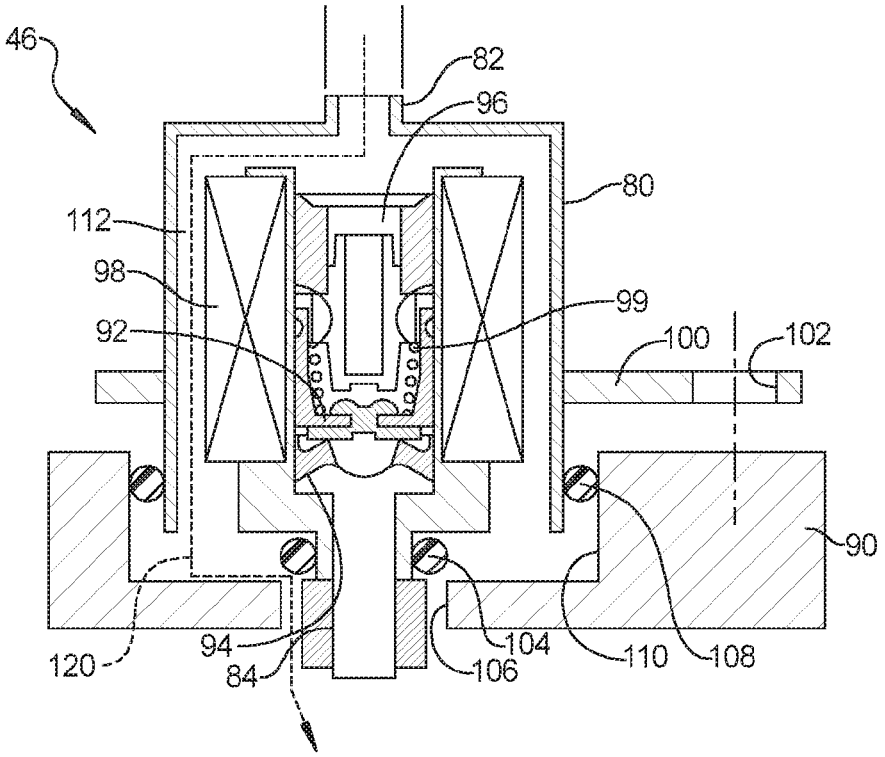
FIG. 4 is an example illustration of the purge valve of FIG. 3 detached from the component of the air intake system.

When the purge valve 46 is assembled incorrectly or has pulled away from its proper mounting location, as shown in FIG. 4, the first O-ring seal 104 is disengaged from the first bore portion 106 while the second O-ring seal 108 remains in sealing engagement with the second bore portion 110 and the housing 80. In this state, a communication path 112 is established between the inlet port 82 and the intake system 12 as shown by the dashed line 120.

The valve member 92 regulates fuel vapor flow through the outlet port 84. Fuel vapor output from the outlet 84 flows into the component 90 and into the air stream for combustion within the engine 10 when the purge valve 46 is attached to the component 90. As the port valve seat 94 is blocked by the valve member 92, fuel vapor flow through the outlet port 84 of the purge valve 46 is blocked when the purge valve 46 is attached to the component 90 of the intake system 12.

The ECM 20 controls opening and closing of the valve member 92 to control the flow of fuel vapor into the component 90 of the intake system 12. For example only, as described above, the ECM 20 may control a duty cycle of a signal applied to the valve member 92 to control the opening and closing of the valve member 92.

A pressure sensor 130 (FIG. 2) measures a pressure at a location between the pump 48 and the purge valve 46. Based on the pressure measured using the pressure sensor 130, the ECM 20 diagnoses whether the purge valve 46 is detached from the component 90 of the intake system 12. When the purge valve 46 is detached from the component 90 of the intake system as illustrated by FIG. 4, fuel vapor can flow through the intake system 12 via flow path 120. When the valve member 92 is closed and the pump 48 is on, a failure of the pressure measured by the pressure sensor 130 to increase may therefore indicate that the purge valve 46 is detached from the component 90 of the intake system 12.

While the ECM 20 will be discussed as diagnosing detachment of the purge valve 46 from the component 90, the diagnosis may be performed by another suitable module of a vehicle.

Figure 5:
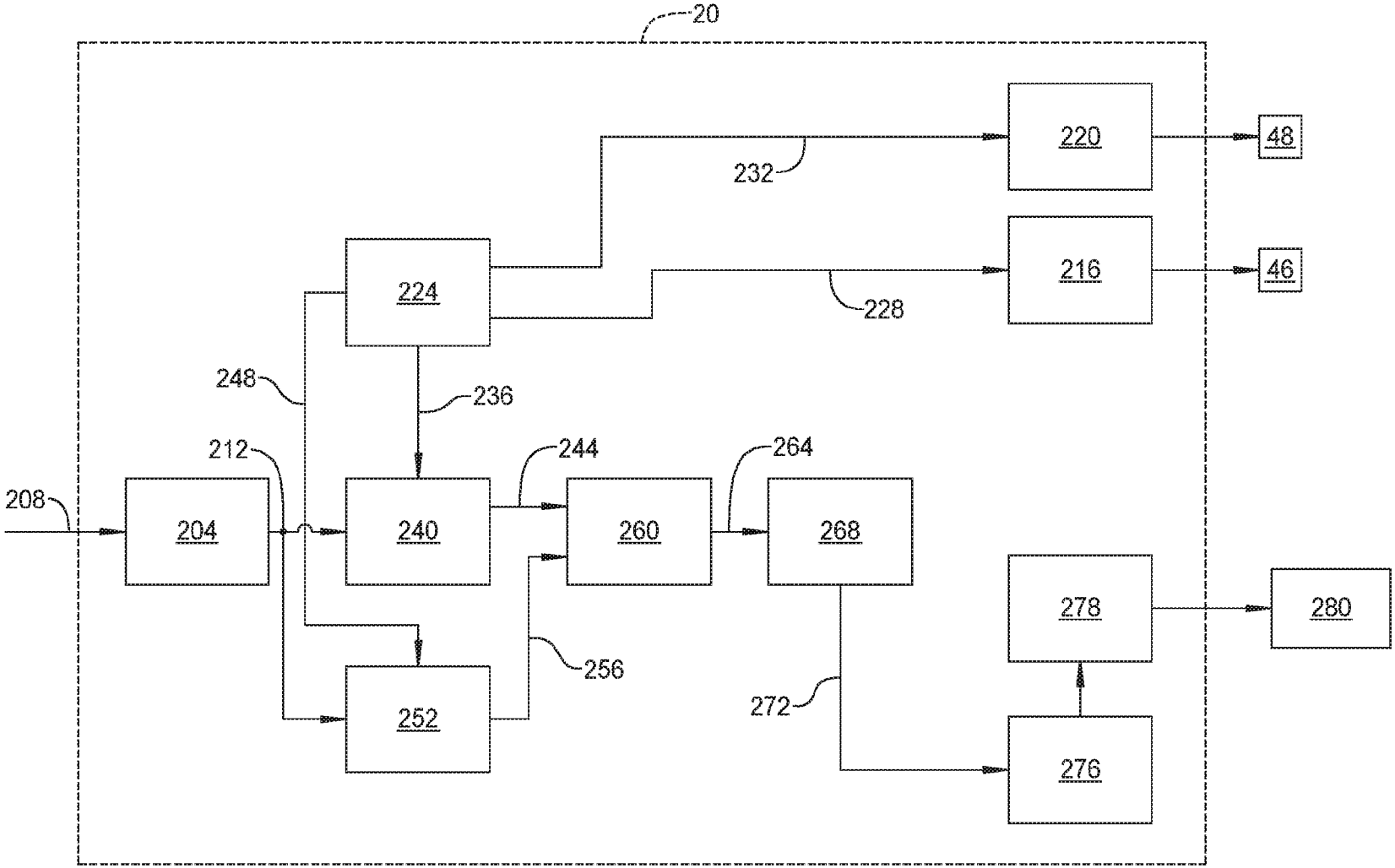
FIG. 5 is a functional block diagram of an example portion of an engine control module.

FIG. 5 is a functional block diagram of an example portion of the ECM 20. A sampling module 204 receives the pressure signal 208 from the pressure sensor 130. The sampling module 204 samples the pressure signal 208 and outputs pressure samples 212. The sampling module 204 may also buffer, digitize, filter, and/or perform one or more other functions to produce the pressure samples 212.

A purge valve control module 216 controls the purge valve 46. A pump control module 220 controls the pump 48. A triggering module 224 triggers performance of various functions for the diagnosis of whether the purge valve 46 is detached from the component 90 of the intake system 12.

For example, the triggering module 224 generates a first trigger signal 228. In response to the first trigger signal 228, the purge valve control module 216 closes the purge valve 46 to fully closed. In this manner, fuel vapor flow through the outlet port 84 is blocked.

After generating the first trigger signal 228, the triggering module 224 generates a second trigger signal 232. The triggering module 224 may generate the second trigger signal 232, for example, a first predetermined period after generating the first trigger signal 228. In response to the second trigger signal 232, the pump control module 220 turns the pump 48 on.

If the purge valve 46 is properly attached to the intake system 12, the pressure measured by the pressure sensor 130 should increase. The pressure should increase because fuel vapor flow through the outlet port 84 is blocked (via the closed purge valve 46). However, if the purge valve 46 is detached from the intake system 12, or if there is a break or other compromise at the outlet port between the valve and the O-ring, the pressure may not increase or may increase less than expected. This may be due to fuel vapor flowing through the second passage 120.

After generating the first trigger signal 228, the triggering module 224 generates a third trigger signal 236. The triggering module 224 may generate the third trigger signal 236, for example, a second predetermined period after generating the first trigger signal 228. The triggering module 224 may generate the third trigger signal 236 before or after generating the second trigger signal 232 (i.e., before or after the pump 48 is turned on). In response to the generation of the third trigger signal 236, a first pressure module 240 stores the pressure sample 212 and outputs the stored pressure sample as a first pressure 244.

The triggering module 224 generates a fourth trigger signal 248 after generating the third trigger signal 236. The triggering module 224 may generate the fourth trigger signal 248, for example, a third predetermined period after generating the third trigger signal 236. In response to the generation of the fourth trigger signal 248, a second pressure module 252 stores the pressure sample 212 and outputs the stored pressure sample as a second pressure 256. When the purge valve 46 is attached to the intake system 12, the second pressure 256 should be greater than the first pressure 244 since flow through the purge valve 46 and into the intake system 12 is blocked.

A difference module 260 may be implemented to determine a pressure difference 264 between the second pressure 256 and the first pressure 244. For example, the difference module 260 may set the pressure difference 264 based on or equal to the second pressure 256 minus the first pressure 244.

A diagnostic module 268 determines whether the purge valve 46 is detached from the component 90 of the intake system 12. Detachment of the purge valve 46 from the intake system 12 includes leaks between the purge valve 46 and the intake system 12 (e.g., one or more leaks in a valve seat between the purge valve 46 and the intake system 12). For example, the diagnostic module 268 may diagnose that the purge valve 46 is detached from the component 90 of the intake system 12 when the pressure difference 264 is less than a predetermined pressure. The predetermined pressure may be calibrated and is greater than zero. The diagnostic module 268 may diagnose that the purge valve 46 is attached to the component 90 of the intake system 12 when the pressure difference 264 is greater than the predetermined pressure. In various implementations, the diagnostic module 268 may determine whether the purge valve 46 is detached based on a comparison of the second pressure 256 with the first pressure 244.

When the purge valve 46 is detached from the component 90 of the intake system 12, the diagnostic module 268 stores a predetermined diagnostic trouble code (DTC) 272 in memory 276. The predetermined DTC indicates that the purge valve 46 is detached from the component 90 of the intake system 12. A monitoring module 278 monitors the memory 276 and illuminates a malfunction indicator lamp (MIL) 280 when the purge valve 46 is detached from the component 90 of the intake system 12.

The MIL 280 may, for example, indicate that it may be appropriate to seek servicing for the vehicle. Upon servicing the vehicle, a vehicle service technician may access the memory 276. The predetermined DTC may serve to indicate to the vehicle service technician that the purge valve 46 is detached from the intake system 12. One or more other remedial actions may also be taken when the purge valve 46 is detached from the intake system 12. As one example, the pump 48 may be disabled. Additionally, the purge valve 46 may be opened and the switching valve 50 may be actuated to the vent position to equalize the pressure across the vapor canister 44.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A vapor purge system for an internal combustion engine, comprising:

a purge canister;

a purge valve having a housing including an input port in communication with the purge canister and including an output port in communication with an intake system; and an intake system component defining a first bore portion receiving the output port with a first seal member disposed therebetween, the intake system component further including a second bore portion receiving a housing portion of the purge valve with a second seal member disposed therebetween, wherein the first and second seal members are positioned such that when the housing is pulled away from the intake system component and the first seal member is out of engagement between the first bore and the output port, the second seal member can remain in engagement between the second bore portion and the housing portion of the purge valve, so that a disconnect or other leak condition at the output port can be detected without any leakage to the atmosphere.

2. The vapor purge system for an internal combustion engine according to claim 1, further comprising a control module for controlling opening of the purge valve.

3. The vapor purge system for an internal combustion engine according to claim 2, further comprising a pressure sensor disposed between a pump and the purge valve, the pressure sensor providing a pressure signal to the control module for diagnosing whether the purge valve is detached from the intake system component.

4. A vapor purge system for an internal combustion engine, comprising:

a purge canister;

a purge valve having a housing including an input port in communication with the purge canister and including an output port; and an intake system component defining a first bore portion receiving the output port;

a control module for controlling opening of the purge valve;

a pressure sensor disposed between a pump and the purge valve, the pressure sensor providing a pressure signal to the control module, the control module diagnosing whether the purge valve is detached from the intake system component by activating the pump when the purge valve is closed and determining whether the pressure increases as expected if the purge valve were properly connected.

* * * * *